US011927091B2

(12) United States Patent
Brackin et al.

(10) Patent No.: US 11,927,091 B2
(45) Date of Patent: Mar. 12, 2024

(54) DRILL BIT WITH RECIPROCATING GAUGE ASSEMBLY

(71) Applicant: Halliburton Energy Services, Inc., Houston, TX (US)

(72) Inventors: Van Jordan Brackin, Spring, TX (US); Trung Huynh, Houston, TX (US); Kelley Leigh Plunkett, The Woodlands, TX (US); Kevin Clark, Conroe, TX (US); Andrew David Lake, Tomball, TX (US); Darien Louis Gurka, Jr., Splendora, TX (US); Daniel Brendan Voglewede, Conroe, TX (US); Curtis Clifford Lanning, Montgomery, TX (US); William Brian Atkins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 159 days.

(21) Appl. No.: 17/138,195

(22) Filed: Dec. 30, 2020

(65) Prior Publication Data

US 2022/0205356 A1 Jun. 30, 2022

(51) Int. Cl.

| | |
|---|---|
| ***E21B 47/08*** | (2012.01) |
| ***E21B 12/00*** | (2006.01) |
| *E21B 47/01* | (2012.01) |

(52) U.S. Cl.
CPC ..... *E21B 47/08* (2013.01); *E21B 12/00* (2013.01); *E21B 47/01* (2013.01)

(58) Field of Classification Search
CPC ..... E21B 47/08; E21B 12/00; E21B 47/01; E21B 10/322; E21B 10/325
See application file for complete search history.

(56) References Cited

U.S. PATENT DOCUMENTS

| | | | |
|---|---|---|---|
| 5,553,678 | A | 9/1996 | Barr et al. |
| 6,142,250 | A | 11/2000 | Griffin et al. |
| 9,085,941 | B2 | 7/2015 | Hall et al. |

(Continued)

OTHER PUBLICATIONS

Pastusek, Paul; Brackin, Van (). [Society of Petroleum Engineers SPE Annual Technical Conference and Exhibition—Denver, Colorado (Oct. 5, 2003)] SPE Annual Technical Conference and Exhibition—A Model for Borehole Oscillations. SPE-84448.

(Continued)

*Primary Examiner* — Abby J Flynn
*Assistant Examiner* — Yanick A Akaragwe
(74) *Attorney, Agent, or Firm* — Micheal Jenney; C. Tumey Law Group PLLC

(57) ABSTRACT

A drill bit has a plurality of cutters secured to the bit body, including a gauge cutter defining a gauge diameter of the drill bit. A reciprocating gauge assembly on the bit comprises a cavity defined in the bit body, a piston reciprocably disposed in the cavity, a wear element on an outwardly facing end of the piston, a piston retainer for moveably retaining the piston in the cavity, and a spring biasing the piston outwardly to a neutral position of the wear element with respect to the gauge diameter. The wear element and piston may be urged inwardly in response to an applied load at the drill bit gauge pad, increasing the lateral depth of cut and thereby controlling the aggressiveness of the bit in response to the load.

15 Claims, 8 Drawing Sheets

(56) References Cited

U.S. PATENT DOCUMENTS

| | | | | |
|---|---|---|---|---|
| 10,494,876 | B2 | 12/2019 | Mayer et al. | |
| 10,626,922 | B2 | 4/2020 | Meier et al. | |
| 2012/0318580 | A1 | 12/2012 | Oesterberg | |
| 2015/0191979 | A1 | 7/2015 | Jain et al. | |
| 2016/0032658 | A1 | 2/2016 | Jain | |
| 2017/0241208 | A1* | 8/2017 | Bomidi | F16C 33/366 |
| 2019/0040691 | A1* | 2/2019 | Mayer | E21B 10/62 |
| 2019/0100968 | A1* | 4/2019 | Spencer | E21B 10/55 |

OTHER PUBLICATIONS

Pastusek, Paul E.; Brackin, Van Jordan; Lutes, Paul Joseph (). [Society of Petroleum Engineers SPE Annual Technical Conference and Exhibition—Dallas, Texas (Oct. 9, 2005)] SPE Annual Technical Conference and Exhibition—A Fundamental Model for Prediction of Hole Curvature and Build Rates With Steerable Bottomhole Assemblies. SPE-95546.

Baker Hughes—Terradapt, Available at https://www.bakerhughes.com/integrated-well-services/integrated-well-construction/drilling/drill-bits/adaptive-drill-bits/terradapt-adaptive-drill-bit. Accessed Dec. 23, 2020.

MDBS Cruzer™ Depth-of-Cut Rolling Element, Nov. 2016. H012380.

* cited by examiner

Table 1: Side Forces, Piston Displacement, and Piston Size (EXAMPLE)

| Borehole Dia (inches) | Max Side Force (lbs) | Min Piston Displacement (in) | Max Piston Displacement (in) | Min Piston Dia (in) | Max Piston Dia (in) | Min Spring Rate (lb/in) | Max Spring Rate (lb/in) | Min Borehole/Piston Dia Ratio | Max Borehole/Piston Dia Ratio |
|---|---|---|---|---|---|---|---|---|---|
| 6 | 3000 | 0.010 | 0.094 | 0.5 | 1 | 31,915 | 300,000 | 6:1 | 12:1 |
| 8 | 4000 | 0.010 | 0.126 | 0.5 | 2 | 31,746 | 400,000 | 4:1 | 16:1 |
| 12 | 6500 | 0.010 | 0.189 | 1 | 2.5 | 34,392 | 650,000 | 4.75:1 | 12.67:1 |
| 17 | 10000 | 0.010 | 0.267 | 1.5 | 3 | 37,453 | 1,000,000 | 11.3:1 | 6.8:1 |
| 71 | 72 | 73 | 74 | 75 | 76 | 77 | 78 | 79 | 80 |

DRILL BIT WITH RECIPROCATING GAUGE ASSEMBLY

BACKGROUND

Oil and gas wells are drilled by rotation of a drill bit at the end of a drill string. The drill bit may be rotated using surface equipment to rotate the entire drill string, and/or a downhole mud motor to rotate the bit relative to the drill string. The drill string may be extended by progressively adding segments of drill pipe from the surface of the wellsite until the well has reached the desired depth. While drilling, drilling fluid is pumped down the drill string, through nozzles on the drill bit, and up an annulus between the drill string and formation to remove cuttings and debris to the surface.

One type of drill bit used to drill wellbores is a fixed cutter bit, having a plurality of cutters secured at fixed positions. The bit body may be formed from a high strength material, such as tungsten carbide, steel, or a composite/matrix material. The cutters may include a substrate made of a carbide (e.g., tungsten carbide), and an ultra-hard cutting table made of a polycrystalline diamond material or a polycrystalline boron nitride material deposited onto or otherwise bonded to the substrate. Over time, the drill bit may gradually wear and/or fail from high forces exerted on the drill bit as it bears against the formation while drilling.

BRIEF DESCRIPTION OF THE DRAWINGS

These drawings illustrate certain aspects of some of the embodiments of the present disclosure and should not be used to limit or define the method.

DETAILED DESCRIPTION

A reciprocating gauge assembly and related methods are disclosed for dynamically adapting side cutting based on applied load to the gauge pad of a drill bit. The reciprocating gauge assembly may include a piston and wear element outwardly-biased to an initial (neutral) distance under gauge as measured between the gauge cutter and the wear element. The wear element may thereby limit and control a lateral depth of cut of the gauge cutter. The wear element and piston are urged inwardly in response to a threshold level of force applied at the drill bit gauge pad, increasing the distance between the gauge cutter and the wear element and thereby controlling the aggressiveness of the bit in response to the load. The bit may allow for maximum steerability and full side-cutting efficiency (SCE) on the positive displacement motor (PDM) during curve applications, and a reduction in SCE under high dynamic loads (e.g., when using a rotating bent motor) while in a lateral wellbore section. The reciprocating gauge assembly may dynamically adjust the lateral depth of cut (DOC) and SCE responsive to lateral forces while drilling. This disclosure relates not only to aspects of the mechanical design of the moveable gauge components, but also to a method of bit design and a method of drilling.

In one example, the reciprocating gauge assembly may have a piston with a dome-topped polycrystalline diamond compact (PDC) as the wear element, backed by a set of compression springs to bias the assembly radially outward. A piston retainer includes a retention hole defined transversely through the piston, and a fastener (e.g. a retention pin) extending through the retention hole and into the bit body to retain the piston within the cavity. The retention hole in the piston is wider than the fastener in an axial direction of the piston to allow reciprocation of the piston within the cavity. The gauge pad may be biased to a neutral position (e.g. 0.010 inches under gauge) to engage the borehole with higher bit tilt angles.

Figure 1:
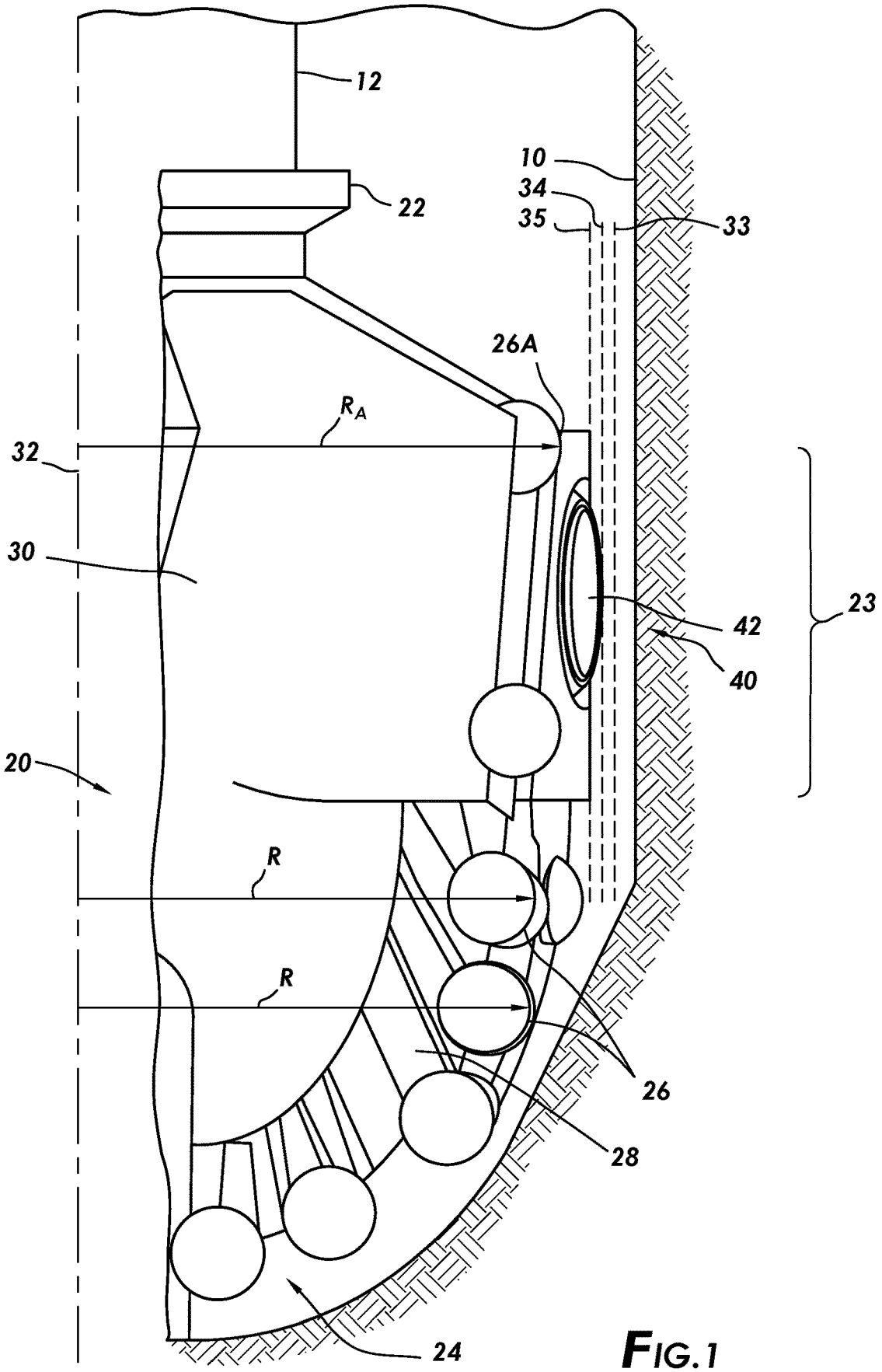
FIG. 1 is a partial side view of a fixed cutter drill bit 20 having one or more reciprocating gauges according to aspects of this disclosure.

FIG. 1 is a partial side view of a fixed cutter drill bit 20 having one or more reciprocating gauges 40 according to aspects of this disclosure. The bit 20 includes an upper end 22 for connecting the bit 20 to a drill string 12 that extends to the surface of the wellsite, and a lower end 24 or cone that axially engages the formation while drilling the wellbore 10. The main central structure of the drill bit 20 is known as the bit body 30 and may be formed from a high strength material, such as tungsten carbide, steel, or a molded composite/matrix material. An outwardly extending structure known as a blade 28 supports a plurality of cutters 26 arranged along the blade 28 from the cone 24 of the drill bit nearest the bit axis 32 up to a gauge section or gauge pad 23 near the outer diameter of the bit 20. Additional blades (not shown) are circumferentially spaced from each other around the bit body 30, each having a similar arrangement of cutters 26. The outermost cutter on each blade 28 may be referred to as the gauge cutter 26A, which is at the largest radius from the bit axis 32. When drilling, weight may be applied to the drill bit 20 by the drill string 12 as the bit 20 is rotated about the bit axis 32. The cutters 26 of the blades 28 engage the formation to cut (e.g. scrape, gouge, shear, or otherwise disintegrate) the earthen material. Drilling fluid ("mud") is circulated downhole through the drillstring 12 and up through the annulus around the drill string 12, to cool the bit 20 and remove the cuttings and other debris to the surface. As further discussed below, the reciprocating gauge 40 bears some of the lateral forces from the wellbore 10 and articulates inwardly in response to the magnitude of those lateral forces to modify the side cutting response of the bit 20.

The overall shape of the bit body 30 is generally symmetrical or balanced about the bit axis 32. Each cutter 26 is radially spaced from the bit axis 32 and sweeps a three-dimensional (3D) cutting path about the rotational axis 32 while drilling. The cutting path while drilling may include both a circular component from rotation of the bit 20 about the bit axis 32 and an axial component in the direction of drilling aligned with the rotational axis 32. The rotational component of the cutting path swept by each cutter 26 has a radius "R" from the bit axis 32 to a radially-outermost cutting edge of the respective cutter 26. The value of "R" differs for each cutter 26 given their different positions along the blade 28. Cutters closer to the cone 24 have a smaller radius from the bit axis 32, whereas cutters closer to the gauge pad 23 have a larger radius. The gauge cutter 26A, being the outermost cutter on each blade 28, has the largest radius $R_A$ from the bit axis 32, and defines the gauge diameter 33 (generally, twice the radius $R_A$) of the bit 20.

Reference lines 33, 34, 35 are drawn parallel to the bit axis 32 to indicate relative positions of drill bit features including the gauge diameter 33, a neutral position 34 of the wear element 42, and a relief limit 35 of the wear element 42. Note that the bit axis 32 and reference lines 33-35 are drawn in the plane of the page of FIG. 1, whereas features of the 3D drill bit 20 are at different circumferential positions about the bit axis 32 and do not lie in the plane of FIG. 1. (A two-dimensional diagram is also provided in FIG. 4.) The wear element 42 of the reciprocating gauge assembly 40 is biased outwardly to the neutral position 34, which is the position of the wear element 42 absent inward loading such as due to lateral wellbore forces. The neutral position 34 in this example is under gauge, and is therefore radially inward of the gauge diameter 33 as determined by the gauge cutter 26A. When drilling a straight section of the borehole 12, there may be no appreciable lateral contact or forces on the wear element 42. The wear element may limit the lateral depth of cut of the gauge cutter 26A. A variety of loading conditions may introduce lateral forces, such as gyrations from a mud motor, drill string dynamics, or when drilling a curved or deviated wellbore. The wear element 42 may bear some of the lateral loads and may be urged inwardly in response to some minimum threshold of lateral force countered by the biasing force provided by a spring on the wear element 42. The wear element 42 has a range of travel (i.e. stroke length) with respect to the bit body 30, up to a maximum inward travel (i.e. relief limit) 35. Thus, the reciprocating gauge assembly 40 may absorb and optionally dampen lateral forces. The neutral position 34 being under gauge, and therefore inward of the gauge diameter 33, provides a lateral depth of cut control with respect to the gauge cutter 26A, which depth may increase in response to inward movement of the wear element up to the relief limit 35.

The wear element 42 may be any suitably hard and wear-resistant material capable of bearing against an earthen formation under lateral drilling forces. The wear element 42 may be formed of the same material or class of materials as the cutting tables used in the various cutters 26. The wear element 42 and/or cutting tables of the cutters 26 may be made of a variety of ultra-hard materials including, but not limited to, polycrystalline diamond (PCD), thermally stable polycrystalline diamond (TSP), cubic boron nitride, impregnated diamond, nanocrystalline diamond, ultra-nanocrystalline diamond and ceramic hybrids including silicon, alumina, zirconia, and any derivatives and combinations thereof However, whereas PDC in a cutter's diamond table is shaped and oriented to form a cutting edge that cuts into the formation 10, the PDC or other material used in a wear element may have a rounded, domed, and/or smooth profile that bears against the formation 10. The diamond edge at the OD maybe benefit from a transitioning edge to prevent potential chipping.

In one example, the wear element 42 may be a PDC diamond table, with no cutting edge, secured to a carbide, e.g. tungsten carbide (WC) substrate. The diamond table may be secured by a high-temperature, high-pressure (HTHP) process whereby the diamond table is simultaneously formed and bonded to the substrate. Alternatively, the diamond table can be separately formed and then attached to the substrate such as by brazing. The wear element or a substrate thereof may be secured to the piston such as by brazing or press-fitting.

Figure 2A:
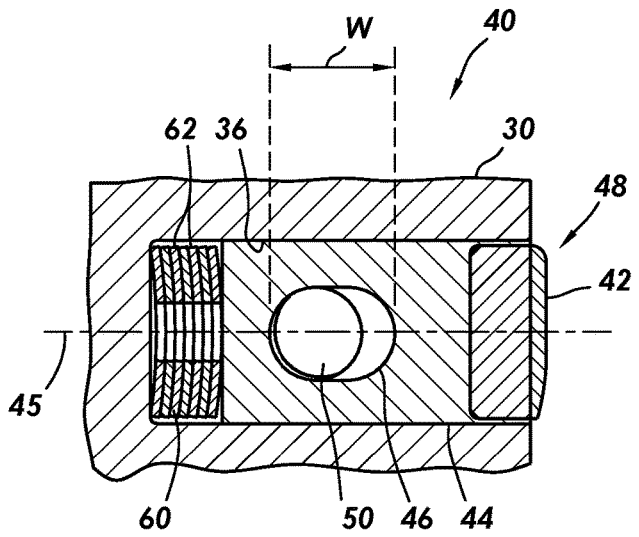
FIG. 2A is a cross-sectional side view of the reciprocating gauge assembly according to a preferred example configuration.

FIG. 2A is a cross-sectional side view of the reciprocating gauge assembly 40 according to a preferred example configuration. A portion of the bit body 30 is included in this view for reference. A cavity 36 defined in the bit body 30 receives a piston, having an outer profile that conforms closely with an internal profile of the cavity 36 for axially reciprocating therein in a direction of a piston axis 45. In this example, the profile of the piston 44 and cavity 36 are generally circular. A piston retainer for moveably retaining the piston in the cavity includes a retention hole 46 defined transversely through the piston 44 and a fastener 50 extending through the retention hole 46 and into the bit body 30 (orthogonal to the page) to retain the piston 44 within the cavity 36. The retention hole 46 in the piston 44 is wider than the fastener 50 in at least the axial direction of the piston to allow reciprocation of the piston 44 within the cavity 36. In this example the fastern 50 has an optionally circular profile, and the retention hole is elongated in the axial direction to a width "W" that is greater than the outer diamer (OD) of the fastener 50.

The wear element 42 is on an outwardly facing or exposed end 48 of the piston 44 facing outwardly from the drill bit, away from the bit axis 32 (FIG. 1). A spring 60 biases the piston 44 outwardly toward the neutral position of the wear element 42. The spring 60 in this example includes a stack of compression members ("washers") 62 with a high spring constant in terms of the magnitude of inward force against the wear element 42 required to urge the piston 44 inward to the full travel of the piston (to the gauge relief limit position). The overall spring constant may be tuned by selecting the stiffness of the individual compression washers 62 as well as the number of compression washers 62. A range of travel of the piston 44 is limited by the width W of the retention hole 46, but may be further limited depending on the total amount of compression allowed by the washers 62 until they are fully compressed in this example.

Figure 2B:
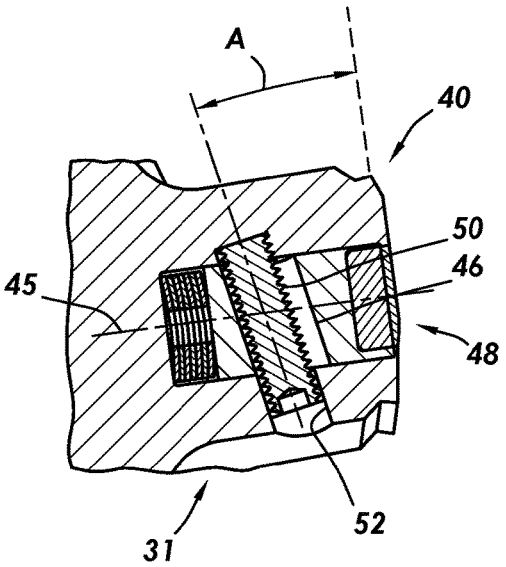
FIG. 2B is a cross-sectional side view of the reciprocating gauge assembly of FIG. 2A, from a different viewing direction.

FIG. 2B is a cross-sectional side view of the reciprocating gauge assembly 40 of FIG. 2A, from a different viewing direction. Whereas in FIG. 2A the fastener 50 was extending into the page, in FIG. 2B, the viewing plane shows a side view of the fastener 50. A receiving hole 52 extends from an exterior of the bit body generally indicated at 31, to the retention hole 46 in the piston 44 for receiving the fastener 50 through the receiving hole 52 into the retention hole 46, and into another portion of the receiving hole 52 on the opposite side of the piston 44. A threaded connection is provided between the fastener 50 and the receiving hole 46. A variety of threaded connections are within the scope of this disclosure; in this example the fastener is a threaded member such as a bolt that threadedly engages a threaded portion of the receiving hole 52 on one or both sides of the piston 44.

The retention hole 52 and the fastener 50 are also angled in this configuration with respect to the outwardly facing end 48 of the piston 44. The angle "A" between the retention hole 52 and the outwardly facing end 48 of the piston may be between 1 to 50 degrees. This angle A may provide access by a removal tool as compared with a zero-angle, i.e., in which the fastener 50 is parallel to the outwardly facing end.

Figure 3A:
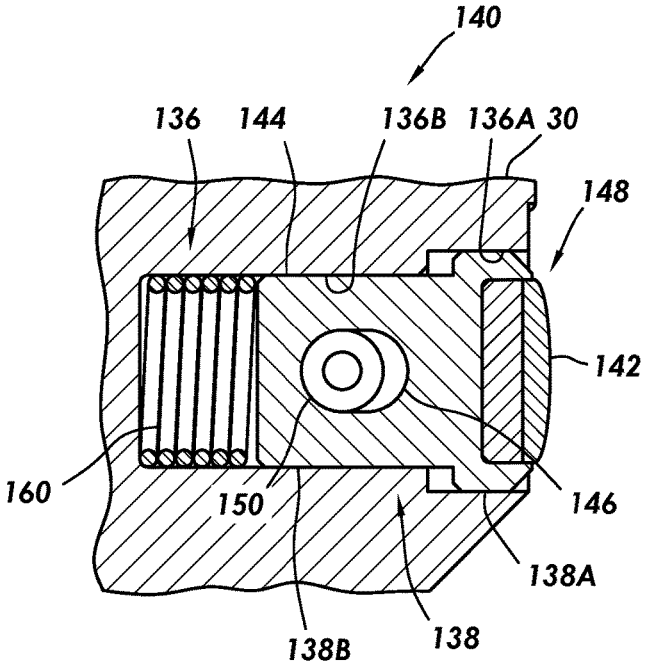
FIG. 3A is cross-sectional side view of another example configuration of a reciprocating gauge assembly with a dual-diameter piston and cavity.

FIG. 3A is cross-sectional side view of another example configuration of a reciprocating gauge assembly 140, with a dual-diameter piston 144 and cavity 136. A dual-diameter outer profile 138 of the piston 144 includes a larger diameter portion 138A that extends to the outwardly-facing end 148 of the piston 144 and a reduced diameter portion 138B axially inward of the larger diameter portion 138A. The cavity 136 includes an inner profile that closely conforms with the cavity 136 including at least a larger diameter bore 136A about the larger diameter portion 138A of the piston 144 for axially reciprocating therein. The cavity 136 also includes a reduced diameter portion 136B that closely conforms with the reduced diameter portion 138B of the piston 144, although in other embodiments the cavity may instead have a constant diameter.

The dual-diameter profile of the piston 144 has various technical advantages. For example, the outwardly facing end 148 is at the end of the larger diameter portion 138A of the piston 144, and provides extra mounting width and area to mount the wear element 142. The reduced diameter portion 138B requires less material removal from the bit body 30 to form the cavity, which may be less expensive to manufacture and help preserve the structural integrity of the bit body 30. Alternative embodiments having a constant-diameter cavity may alternatively provide radial clearance about the reduced diameter portion 138B of the piston 144, such as for a spring or retention hardware.

Similar to FIGS. 2A-2B, a piston retainer for moveably retaining the piston in the cavity 136 includes a retention hole 146 defined transversely through the piston 144 and a fastener 150 extending through the retention hole 146 and into the bit body 30 (orthogonal to the page in FIG. 3A) to retain the piston 144 within the cavity 136. The retention hole 146 in the piston 144 is wider than the fastener 150 in at least the axial direction of the piston to allow reciprocation of the piston 144 within the cavity 136. In this example, as in the example of FIGS. 2A-3A, the fastener 150 also has an optionally circular profile, and the retention hole is elongated in the axial direction to a width that is greater than the outer diamer (OD) of the fastener 150. A spring 160 biases the piston 144 outwardly toward a neutral position of the wear element 142 as generally discussed above. The spring 160 is illustrated as a coil spring in this example. A range of travel of the piston 144 is limited by the width of the retention hole 146, but may be further limited depending on the total amount of compression allowed by the spring 160 until it is fully compressed.

It should be noted that, for any given configuration, numerous alternative spring configurations are available beyond the specific examples shown in the drawings. Alternative spring elements may include, for example, elastomers, compression springs, shape memory alloy springs, Belleville springs, spring bellows, and combinations thereof. The overall spring constant may be tuned, in the case of a coil spring example, by selecting the stiffness of the material, the thickness of the coil, and so forth. The spring rate could also be tuned using a stack of different thickness Belleville washers that, as a composite stack, gives a variable spring rate. Instead of Belleville washers, a compression spring with varying spring rates may be used. A variable spring rate could also be provided, such that either the spring rate requires more force to displace the assembly at first and then less force after the spring has been compressed a certain stroke length, or vice versa, depending on the desired SCE for the application. The spring rate may also be selected based on the rock compressive strength in that application, as well as the anticipated side load, which may in turn be determined based on the type of motor used in the application. The spring rate may also take into account at-the-bit bending-on-bit data, adjusting the stiffness to get more or less engagement depending on the desired SCE for the application.

Figure 3B:
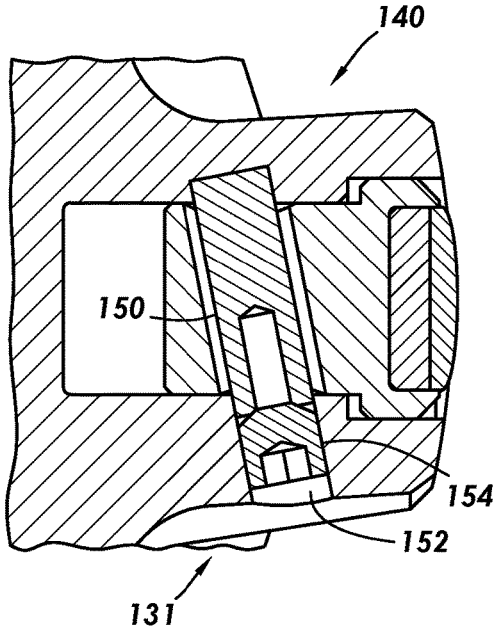
FIG. 3B is a cross-sectional side view of the reciprocating gauge assembly of FIG. 3A, from a different viewing direction.

FIG. 3B is a cross-sectional side view of the reciprocating gauge assembly 140 of FIG. 3A, from a different viewing direction. The piston retainer includes a receiving hole 152 that extends from an exterior 131 of the bit body to the retention hole 146 in the piston 144, for receiving the fastener 150 through the receiving hole 152 into the retention hole 146, and into another portion of the receiving hole 152 on the opposite side of the piston 144. However, the fastener 150 in this example may be a pin with no external threading. The threaded connection in this example instead comprises a set screw 154 that backs the pin and is received into an internally-threaded portion of the pin.

Figures 4, 5:
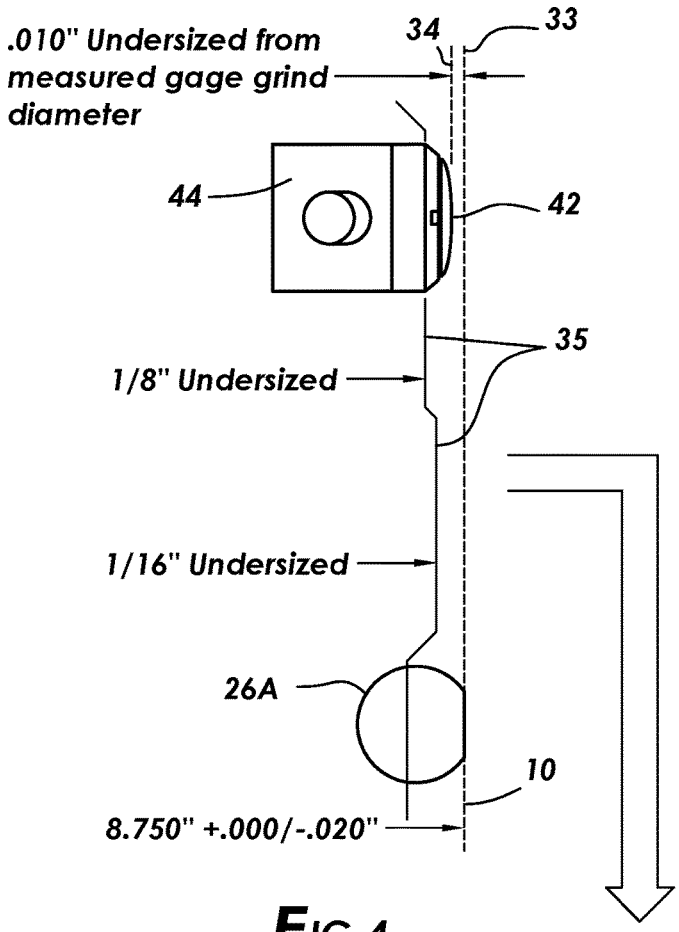
FIG. 4 is a diagram, with an accompanying chart in FIG. 5, of some exemplary geometry and dimensional constraints for a reciprocating gauge assembly.
FIG. 5 is a chart of example geometry and dimensional constraints for a reciprocating gauge assembly.

FIG. 4 is a diagram, with an accompanying chart in FIG. 5, of some exemplary geometry and dimensional constraints for a reciprocating gauge assembly according to any of the disclosed embodiments. The diagram of FIG. 4 provides a side view of the gauge cutter 26A juxtaposed with a representative piston, such as piston 40 of FIG. 2A (but the chart could be applied to any piston). The vertical references lines from FIG. 1 are included again here to indicate the gauge diameter 33, the neutral position 34 of the wear element 42, and the relief limit 35 of the wear element 42. The gauge diameter 33 is the diameter of the borehole 10 after being cut by the gauge cutter 26A, and the clipped portion of the gauge cutter 26A indicates a depth of engagement between the cutter 26A and rock chip removed as it cuts the formation 10. The neutral position 34 is the radial position of the outermost point of the wear element 42, which may be radially inward of the gauge diameter 33. The relief limit 35 is the radial position of the outermost point of the wear element 42 at the full extent of travel inward as determined by the reciprocating gauge assembly. The relief limit 35 in this example is approximately 0.010" inward of the neutral position 34. Alternatively, the reciprocating gauge assembly may be configured or adjusted to control the piston travel to achieve another relief limit 35, such as ⅛" or 1/16" as alternatively indicated. In some examples, therefore, the neutral position of the wear element is radially inward of the gauge diameter by between 0.010" and 0.125" (0.25 to 3.2 mm).

FIG. 5 is a chart 70 providing some example geometry and dimensional constraints for any given reciprocating gauge assembly that includes a spring-biased piston disposed in a cavity. Four nominal bit/hole sizes are shown in column 71, including a 6-inch, 8-inch, 12-inch, and 17-inch borehole. These holes may correspond with the nominal bit size, i.e., a 6-, 8, 12, or 17-inch drill bit. Each nominal hole size, at least in an idealized case, may be equal to the gauge diameter cut by the gauge cutter(s). Column 72 is the maximum side force according to at least one design. This is the largest expected side load seen by the bit for this hole size. Optionally, these numbers may additionally be used in specifying a design limit and/or force when the piston has reached full travel, i.e., the force when the spring is fully compressed, and the piston is at its maximum displacement from the neutral position. The maximum side force is expected to increase with increasing bit size as indicated in the table. Columns 73 and 74 provide minimum and maximum values of a design piston displacement. For example, a piston design for an 8-inch bit may include a maximum stroke length of anywhere between 0.010 and 0.126 inches (0.25 to 3.2 mm). Columns 75 and 76 provide the minimum and maximum piston diameters. In a piston and cavity profile having multiple diameters (e.g. FIG. 3A), the diameter values in columns 75 and 76 may correspond with the larger diameter portions that receive the wear element at the end. The minimum and maximum spring rates are provided in columns 77 and 78. These values correspond with the minimum allowable spring rates for any one reciprocating gauge assembly and for the given bit size in its row, assuming a linear spring force. In a variable spring rate configuration, these values may also set an upper limit (column 78) for the maximum value of the variable spring rate and a lower limit (column 77) for the minimum value of the variable spring rate. Columns 79 and 80 are the minimum and maximum borehole-to-piston ratios. For example, an 8-inch hole has a minimum piston diameter of 0.5 inch, for a maximum borehole/piston ratio of 16:1.

In any given configuration, a piston geometry may be defined by parameters discussed herein such as stroke length, piston diameter, spring force, borehole size, and so forth. The geometry may be more particularly defined by ratios relating parameters and that have shown to produce good results. The piston diameters are constrained by typical chord lengths for blades in a given size range. The spring deflection may be calculated for a given total spring stack height (limited by cavity depth), according to what is the largest spring deflection (i.e. least stiff spring) with a working load of the corresponding side force. The minimum deflection can be achieved by having a much stiffer spring and is not bound by cavity depth, and so is set to a small deflection. The spring rate is then calculated from force and deflection. In some examples, a ratio of a piston length to a piston outer diameter may be within a range of between 0.5:1 and 3:1. In some examples, a ratio of a piston outer diameter to a wear element diameter may be within a range of between 1.01:1 to 1.5:1.00. In some examples, a ratio of the gauge diameter to a piston outer diameter may be within a range of between 4:1 and 16:1. An example configuration may incorporate more than one of these ratios.

Each of the examples of FIGS. 2A-2B and 3A-3B discussed above have a piston retainer that includes a retention hole defined transversely through the piston, and a fastener extending through the retention hole and into the bit body. Alternative retainer configurations are now discussed that do not require a fastener to pass transversely through a retention hole of a piston.

Figure 6:
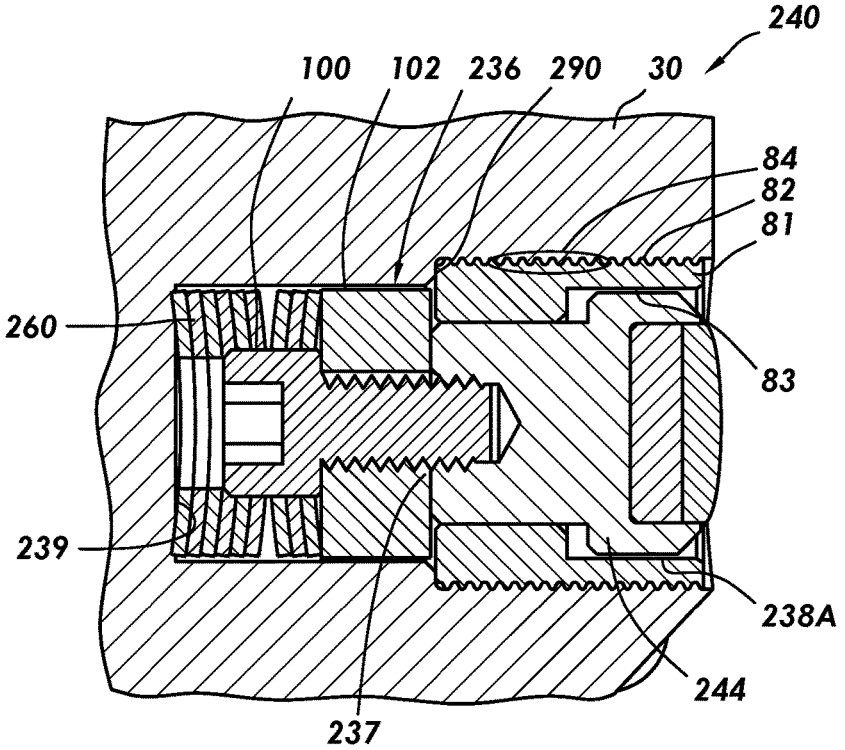
FIG. 6 is a cross-sectional side view of a reciprocating gauge assembly according to another example configuration.

FIG. 6 is a cross-sectional side view of a reciprocating gauge assembly 240 according to another example configuration. A cavity 236 defined in the bit body 30 receives a piston 244, and a sleeve 81 having an outer profile 82 that conforms closely with an internal profile of the cavity 236 and an internal profile 83 that conforms closely with an enlarged diameter portion 238A of the piston 244. In this example, the profile of the piston 244, cavity 236, and sleeve 82 are generally circular. The sleeve 81 may be threadedly engaged to the cavity 236 with a threaded connection 84 and/or welded or otherwise secured to the bit body 30.

A piston retainer for moveably retaining the piston in the cavity 236 includes a threaded member 100 (e.g. a bolt or screw) passing through a collar 102 and threaded into an interior end 237 of the piston 244. The collar 102 abuts the lower end 237 of the piston 244. A spring (e.g. stack of compression washers) 260 is captured between a lower end 239 of the cavity 236 and the collar 102, to bias the piston 244 outwardly over a stroke length determined in part by the maximum spring displacement.

In one method of assembly, the sleeve 81 may be positioned about the piston 244, and the threaded member 100 may be inserted through the collar 102 and threaded into the lower end 237 of the piston 244. The spring 260 is then lowered into the lower end 239 of the cavity 236. The sub-assembly of the piston, sleeve 81, threaded member 100, and collar 102 are then lowered into the cavity 236 until the sleeve 81 abuts an interior shoulder 290 of the cavity 236. In the version with the threaded sleeve shown, lowering the sub-assembly may require threadedly rotating the sleeve 81 into the cavity 236 until it abuts the shoulder 290. The threading in the sleeve 81 may also be used to preload the spring 260. In a tack-welded variation, the sub-assembly may simply be slid into the cavity 236.

Figure 7:
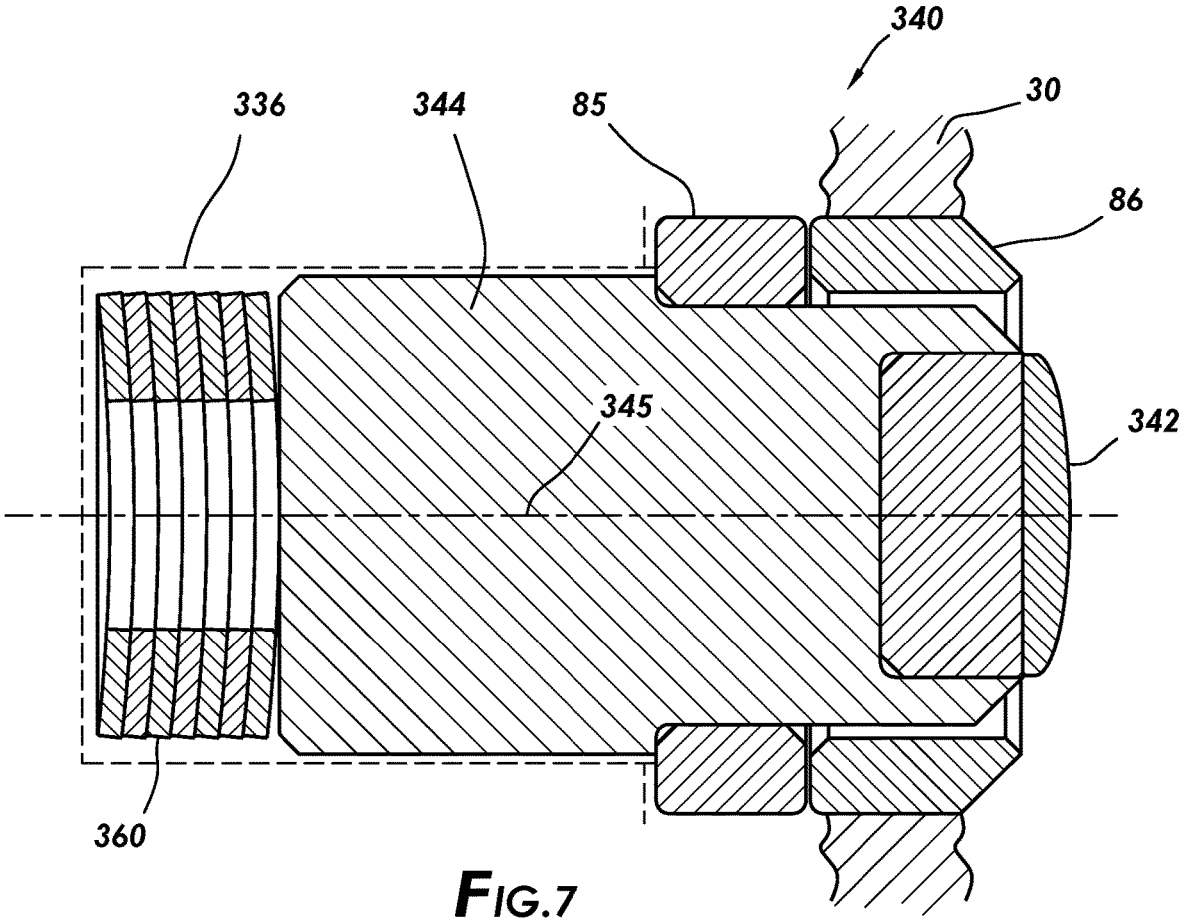
FIG. 7 is a cross-sectional side view of a reciprocating gauge assembly according to another example configuration.

FIG. 7 is a cross-sectional side view of a reciprocating gauge assembly 340 according to another example configuration. A piston is disposed in a cavity 336 in the bit body directly above a spring 360 (e.g. stack of compression washers). A thrust washer 85 is positioned about the piston 344, and a cap 86 is secured to the bit body 30, such as by welding. The thrust washer 85 bears axial pre-loading of the piston 344 by the spring 360. This method of securing the piston 344 may also allow the 342 wear element to rotate about an axis 345 of the piston 344. The sleeve 81 may be a replaceable sleeve, and may be a sacrificial element that provides wear resistance for axial and optional rotation of the piston 344, and that can be replaced when the sleeve 91 wears out. Alternative friction- and wear-reducing elements that may be included in this or any other configuration, with or without a sleeve, include an unsealed bearing grease, a polytetrafluoroethylene (e.g. Teflon®) coating, a ceramic coating, a carbide layer, a nitride layer, or any combination of the foregoing, between the piston and the cavity. The nitride layer may be formed on a piston, for example, by a quench-polish-quench process.

Figure 8:
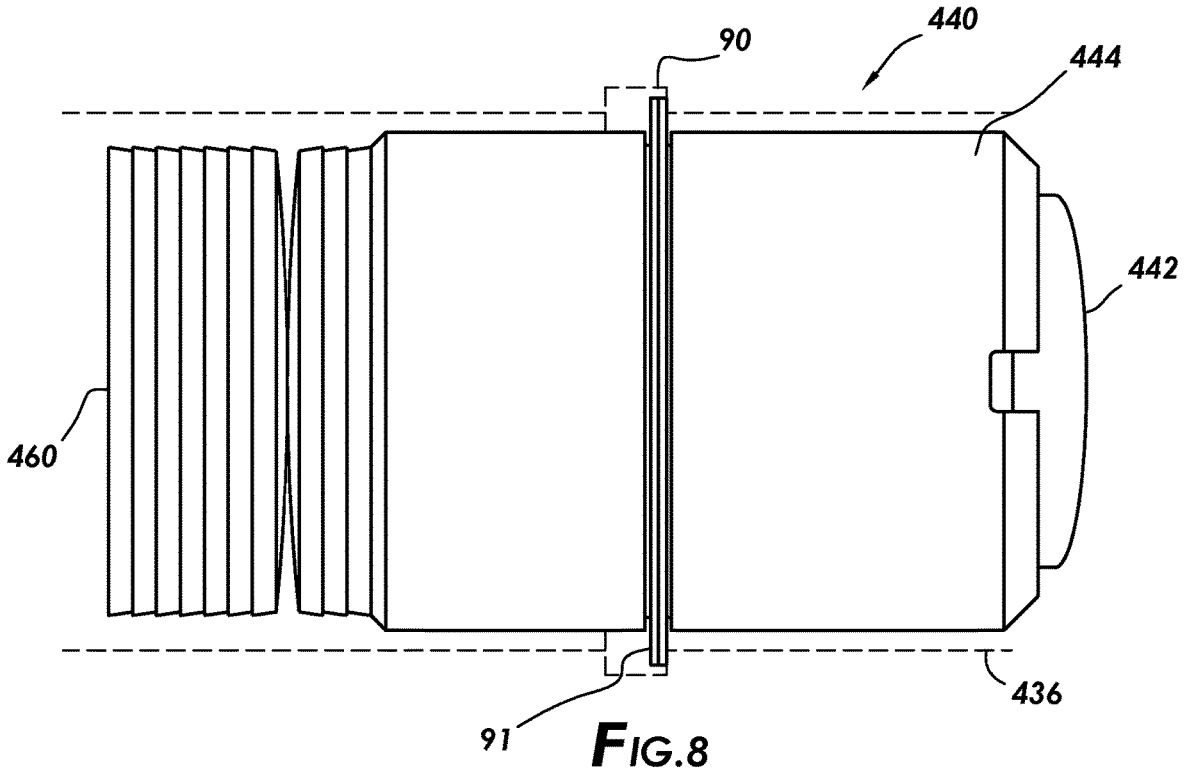
FIG. 8 is a cross-sectional side view of a reciprocating gauge assembly according to another example configuration.

FIG. 8 is a cross-sectional side view of a reciprocating gauge assembly 440 according to another example configuration. A piston 444 is disposed in a cavity 436 in the bit body directly above a spring 460 (e.g. stack of compression washers). A heavy duty retaining ring 90 is positioned about the piston 444 and seats in an elongated groove 91 in the cavity 444. The retaining ring 90 is pre-loaded by the spring 460. The elongated groove 91 provides a range of travel for axial reciprocation of the piston 444. This method of securing the piston 444 may also allow the wear element 442 to rotate about an axis of the piston 444. The drawings are not limited to the scale shown. In the FIG. 8 embodiment, for example, the geometry and dimensions may be adjusted to facilitate assembly. For example, the portion of the piston 444 with the wear element 442 may be reduced in diameter to provide clearance for the retaining ring 90, such as in the example of FIG. 15 discussed below.

A reciprocating gauge assembly according to this disclosure may include any of a variety of piston and wear element configurations. In one example, a PDC dome may be brazed into a steel piston. The piston may have an enlarged diameter portion with a recess to hold a dome-shaped PDC, and a reduced diameter portion which allows for more space for piston retention hardware (e.g. a retention pin) or a set screw to follow the retention pin in the blade. Alternatively, instead of a recess to hold a PDC dome with a single diameter, the carbide substrate of the PDC may be altered to be brazed to a piston that is the same diameter as the PDC. The carbide substrate may have a conical shape, mating to a conical recess in the PDC. The carbide substrate may alternatively have a stepped shape.

Figure 9:
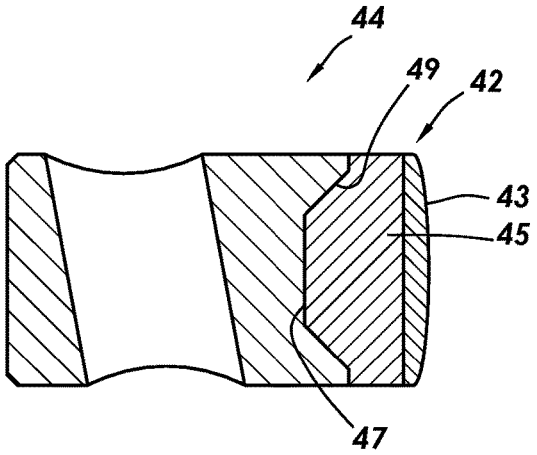
FIG. 9 is a cross-sectional side view of the piston according to an example configuration wherein the wear element and recess comprise complementary conical configurations.

FIG. 9 is a cross-sectional side view of the piston 44 according to an example configuration wherein the wear element 42 and recess comprise complementary conical configurations. More particularly, the wear element 42 includes a PDC diamond table 43 bonded to a substrate 45. The substrate 45 has a conical profile 47 received by a corresponding conical profile 49 on the piston 44.

Figure 10:
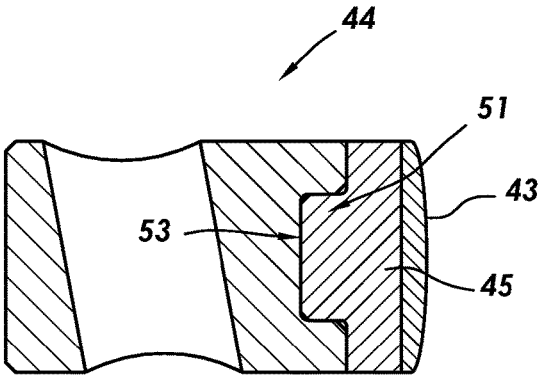
FIG. 10 is a cross-sectional side view of the piston according to another example wherein the wear element and recess comprise complementary stepped configurations.

FIG. 10 is a cross-sectional side view of the piston according to another example wherein the wear element and recess comprise complementary stepped configurations. More particularly, the wear element 42 includes the PDC diamond table 43 bonded to the substrate 45. However, the substrate 45 in this embodiment instead has a stepped profile 51 received by a corresponding stepped profile 53 on the piston 44. The substrate in either example may be bonded, brazed, or otherwise secured to the piston 44. The smaller (minor) diameter of the substrate may be 30% to 95% of the larger (major) diameter.

Alternative wear element and/or piston configurations may include an oblong PDC dome, hardfacing, or an impreg cell used in place of a PDC dome. Alternatives to brazing the PDC dome or other wear element include shrink fitting or press fitting the carbide substrate into a steel piston recess, or shrink fitting or press fitting a spindle on the back of the carbide substrate into a hole in the steel piston. Another alternative is a PDC dome with a carbide substrate that itself acts as the piston, and which is sufficiently long to have retention features such as a groove for a snap ring. Another alternative is a PDC dome with a carbide substrate and a steel substrate bonded to the carbide substrate, either by low strength ("LS") bonding, brazing, welding, or any other suitable means. LS bonding is a brazing process which prevents the diamond from reaching a temperature above 750 C (1382 F), which starts the graphitization of the diamond. LS bonding may be used in a process of brazing carbide to carbide, such as when a carbide extension is brazed onto a short-substrate PDC cutter. Instead of a piston, an arm may be used, or a ramp with one side hinged, the other side having a lip or a catch. Instead of a PDC bonded to the piston, a rolling PDC element may be used to reduce drag forces and torque, and help with toolface control. Instead of a PDC, the exposed portion of the piston may be hardfaced using a carbide coating. The piston design is not limited to steel, and could be made out of a different metal such as carbide or another metal alloy with high strength and a melting point higher than downhole temperatures, such as tungsten alloys or titanium alloys.

FIGS. 11-16 provide schematic drawings of various additional features that may be incorporated into a reciprocating gauge, or any suitable combination of these features.

Figure 11:
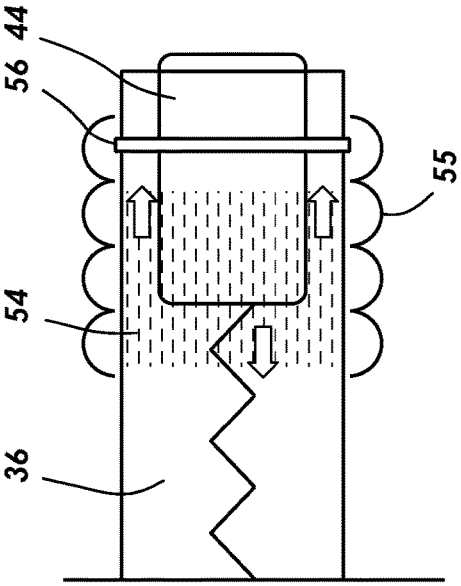
FIG. 11 is a schematic side-view of a piston assembly using a damping fluid to dampen movement of the piston.

FIG. 11 is a schematic side-view of a piston assembly using a damping fluid 54 and a seal 56 between the piston 44 and the cavity 36 to dampen movement of the piston 44 within the cavity 36. The damping fluid 54 may comprise any suitable damping fluid such as silicone oil, to absorb shock to the system and increase component reliability for longer runs. The dampening fluid 54 may be a non-Newtonian fluid with higher resistance to shear stress as higher or sudden impacts, and lower resistance to shear stress at lower or constant shear stress. The dampener could consist of a ferrofluid, activated by an electro magnet 55. The electro magnet (or a series of electro magnets) may be placed towards the front of the bore, so that as the piston pushes the ferrofluid towards the back of the bore with each retraction, the electro magnet pulls the ferrofluid back towards the front of the bore to reset it for each cycle. A fluid port (not shown) may be provided to allow fluid flow to accommodate reciprocation of the piston.

Figure 13:
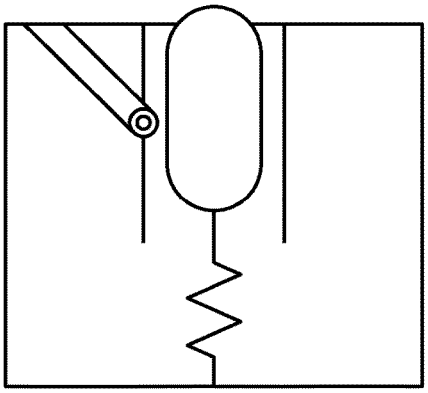
FIG. 13 is a schematic diagram of a piston cavity with a ball race, where multiple ball bearings are used to retain the piston sleeve assembly.
Figure 16:
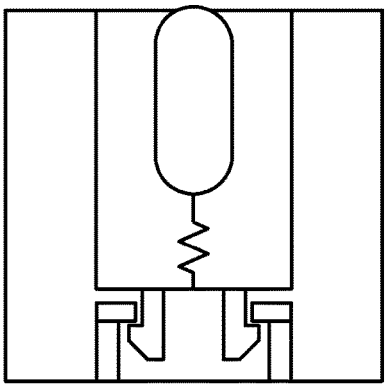
FIG. 16 is a schematic side-view of yet another piston retainer using barbed fittings extending from the inner-most (back surface) of the piston bore.
Figure 12:
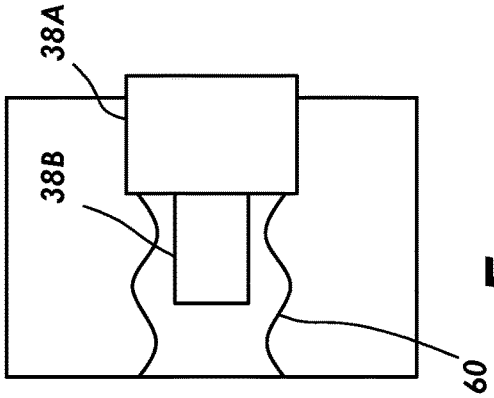
FIG. 12 is a schematic side-view of a piston configuration having a reduced diameter portion, providing radial clearance for a spring bellow disposed about the reduced diameter portion.
Figure 15:
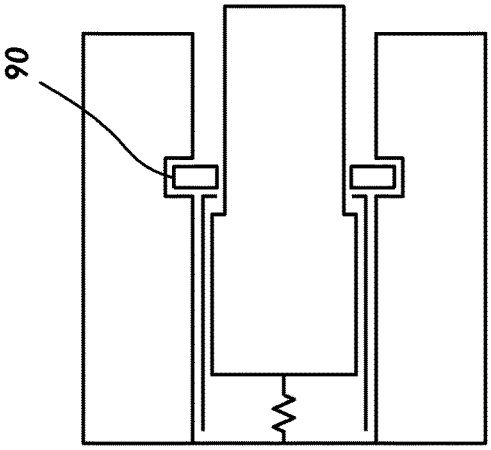
FIG. 15 is a schematic diagram of piston cavity with a groove holding the piston sleeve assembly in with a retaining ring.
Figure 14:
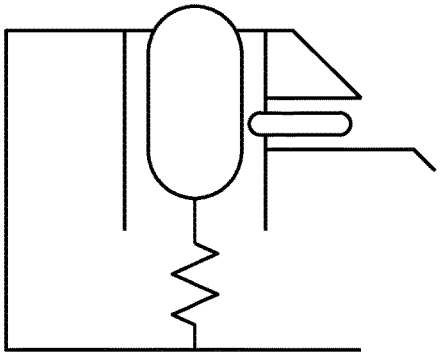
FIG. 14 is a schematic diagram of a piston cavity that allows for the piston to be held by a pin inserted from an access hole on the underside of the gauge pad as shown.

FIGS. 12-16 are schematic side views of a range of alternative retention concepts and features, which may be used in combination with any other suitable features disclosed herein. FIG. 12 is a schematic side-view of a piston configuration having a reduced diameter portion, providing radial clearance for a spring 60 disposed about the reduced diameter portion. The spring may, more particularly, comprise a spring bellow in this example. FIG. 13 shows a piston cavity with a ball race, where multiple ball bearings are used to retain the piston sleeve assembly. An access hole is provided in the gauge pad above the pin cavity where balls can be inserted, and can be plugged after with a small tack weld or a removable plug. FIG. 14 shows a piston cavity that allows for the piston to be held by a pin. The pin is inserted from the access hole on the underside of the gauge pad as shown. Similar to the FIG. 13 concept, the hole would then be plugged after with a tack weld or removable plug. FIG. 15 shows the piston cavity with a groove holding the piston sleeve assembly in with a retaining ring 90. The piston may have a smaller ID protruding out of the retaining ring to facilitate assembly. FIG. 16 is a schematic side-view of yet another piston retainer using barbed fittings extending from the inner-most (back surface) of the piston bore.

Further examples of retainer configurations that may be used with a reciprocating gauge assembly according to this disclosure include spring-loaded pins or bearings recessed either within the piston or the bore of the cavity as the piston is inserted into the cavity, and that snap outwardly or inwardly into place once aligned with complementary holes. In another example, a bore of the cavity may include wings for receiving the ends of the pin into the cavity and the wings are later plugged. Alternative piston retainer mechanisms may include a j-lock groove in the bore, with tabs on the capsule to follow the insertion path, or a nail lock mechanism.

Figure 18:
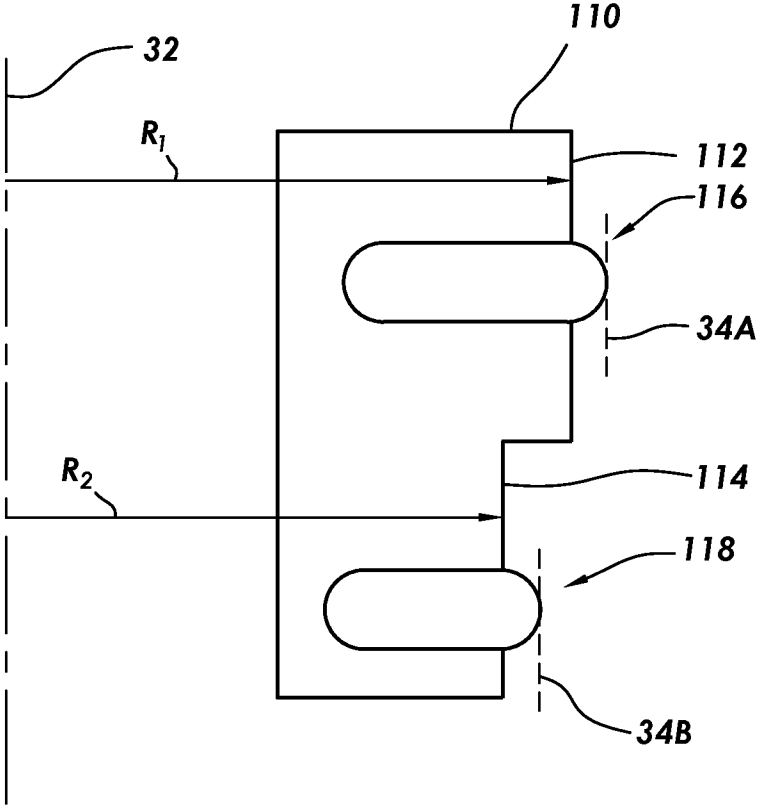
FIG. 18 is a schematic side view of the stepped gauge pad wherein the axially spaced reciprocating gauge assemblies are at different neutral positions.
Figure 17:
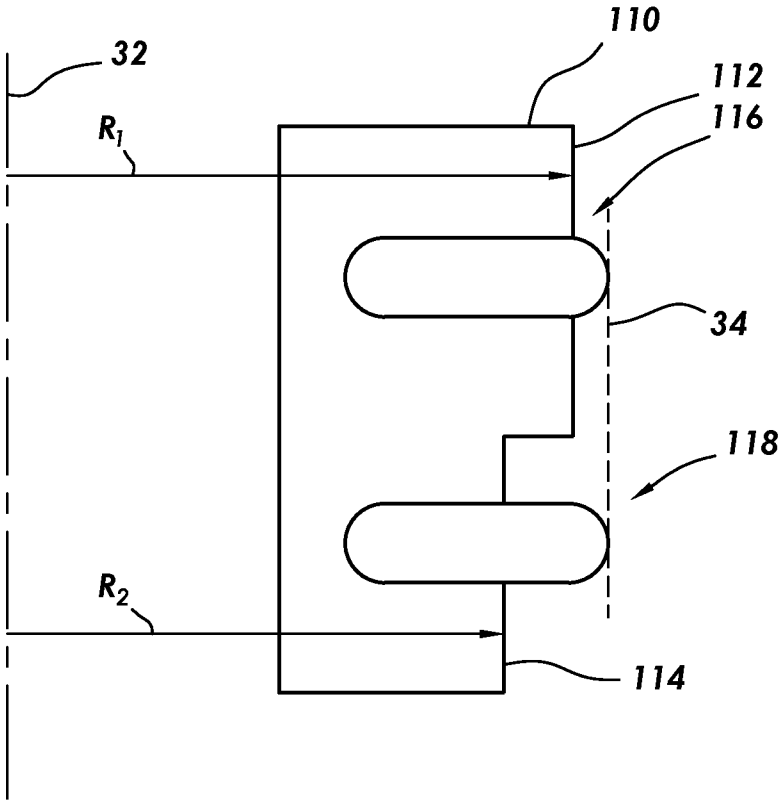
FIG. 17 is a schematic side view of a stepped gauge pad with axially spaced reciprocating gauge assemblies biased to equal neutral positions.

Any number of reciprocating gauge assemblies according to one or more of the example configurations herein may be provided on a drill bit. The reciprocating gauge assemblies, and one or more gauge cutters, may be positioned on or near a gauge section of the drill bit. The reciprocating gauge assemblies may be circumferentially spaced, e.g., with one or more reciprocating gauge assembly per blade. The reciprocating gauge assemblies may also be axially spaced with one another, and optionally axially aligned in a direction of a bit axis. If a gauge pad has multiple gauge relief steps, a moveable piston may be placed on each step, or a selection of steps on the pad. The displacement may vary for each piston on the blade, or could be placed with the same displacement and as such would engage formation sequentially rather than simultaneously. FIGS. 17 and 18 provide some examples.

FIG. 17 is a schematic side view of a gauge pad 110 for a drill bit with axially spaced reciprocating gauge assemblies. The gauge pad 110 may be on or near an outer diameter of a drill bit such as the drill bit 20 of FIG. 1, for supporting a number of reciprocating gauge assemblies. The gauge pad 110 in FIG. 9 is stepped, including a first gauge relief step 112 at a first radius (R1) or corresponding diameter, and a second gauge relief step 114 at a second radius (R2) or corresponding diameter. The neutral position 34 of the pistons and corresponding wear elements may be equal in this example.

FIG. 18 is a schematic side view of the gauge pad 110 with another example of axially spaced reciprocating gauge assemblies 116, 118. The gauge pad 110 in FIG. 10 is also stepped like in FIG. 9. However, the neutral position 34 of the pistons and corresponding wear elements are unequal in this example. Rather, the reciprocating gauge assembly 116 on the first gauge relief step 112 has a neutral position 34A with a larger radius/diameter than the neutral position 34B of the reciprocating gauge assembly 118 on the second gauge relief step 114.

Figure 19:
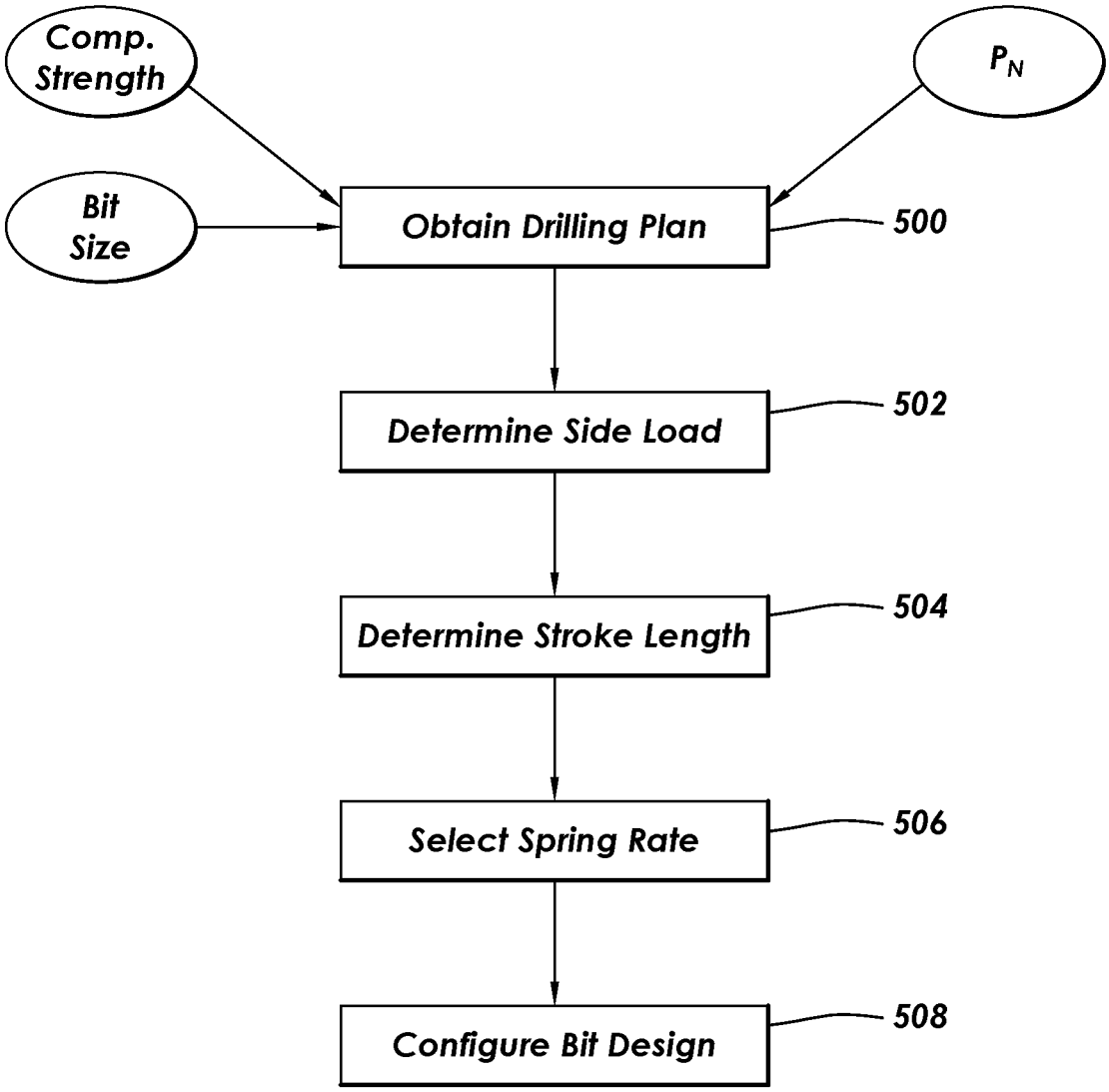
FIG. 19 is a flowchart broadly outlining a design method for configuring a drill bit with a reciprocating gauge assembly according to this disclosure.

FIG. 19 is a flowchart broadly outlining a design method for configuring a drill bit with a reciprocating gauge assembly according to this disclosure. In step 500 a well plan is obtained including a plurality N of drilling parameters P, such as a drill bit size and a rock compressive strength. The well plan may also include other drilling parameters such as a borehole path and radius of curvature at selected locations. An expected side load is determined in step 502 based on the well plan. A stroke length is determined in step 504, based on the drilling parameters, for a reciprocating gauge assembly comprising a cavity defined in the bit body, a piston reciprocably disposed in the cavity, a wear element on an exposed end of the piston, and a piston retainer for moveably retaining the piston in the cavity.

A spring rate is selected in step 506 based on the well plan to bias the piston outwardly to a neutral position of the wear element. The spring rate may be selected, in part, using the table of FIG. 5 based on other parameters of the drill bit and the well plan. A designer could set the spring rate depending on the application, such that either the spring rate requires more force to displace the assembly at first and then less force after the spring has been compressed a certain stroke length, or vice-versa, depending on the desired SCE for the application. The designer may calculate the desired spring rate based on the rock compressive strength in that application, as well as the anticipated side load, which may in turn be determined based on the type of motor used in the application. Additionally, the designer may adjust the spring rate based on at-the-bit bending-on-bit data from a previous bit run in a similar application, adjusting the stiffness to get more or less engagement depending on the desired SCE for the application.

The bit design is then configured in step 508, including a reciprocating gauge assembly incorporating the drill bit size, stroke length, and spring rate.

The drill bit design method may further include obtaining bending-on-bit data and adjusting one or both of the spring rate and the stroke length based on the bending-on-bit data. One or both of the spring rate and the stroke length may be adjusted to achieve a desired side cutting efficiency for the well plan.

A method of drilling a wellbore into a formation is also provided. According to one method, a drill bit is rotated about a rotational axis. A plurality of cutters secured to the bit body cut the formation while rotating the drill bit, including a gauge cutter to cut a gauge diameter. Side loads are generated on the drill bit while drilling, which are dynamically absorbed using a reciprocating gauge as disclosed above. The method may include reciprocably securing the piston within the cavity of the bit body with a fastener extending through a retention hole on the piston and into the bit body, wherein the retention hole in the piston is wider than the fastener in an axial direction of the piston.

Statement 1. A drill bit, comprising: a bit body defining a rotational axis; a plurality of cutters secured to the bit body, including a gauge cutter disposed on a gauge section and defining a gauge diameter of the drill bit; and a reciprocating gauge assembly comprising a cavity defined in the bit body, a piston reciprocably disposed in the cavity, a wear element on an outwardly facing end of the piston, a piston retainer for moveably retaining the piston in the cavity, and a spring biasing the piston outwardly to a neutral position of the wear element under gauge.

Statement 2. The drill bit of statement 1, wherein the piston retainer comprises: a retention hole defined transversely through the piston; and a fastener extending through the retention hole and into the bit body to retain the piston within the cavity, wherein the retention hole in the piston is wider than the fastener in an axial direction of the piston to allow reciprocation of the piston within the cavity.

Statement 3. The drill bit of statement 2, further comprising: a receiving hole extending from an exterior of the bit body to the retention hole in the piston for receiving the fastener through the receiving hole into the retention hole; and wherein the retention hole is angled between 1 to 50 degrees with respect to an outer face of the piston.

Statement 4. The drill bit of statement 3, further comprising a threaded connection between the fastener and the receiving hole on the bit body.

Statement 5. The drill bit of any of statements 2-4, wherein the piston comprises a dual-diameter outer profile including a larger diameter portion that extends to the outwardly-facing end of the piston and a reduced diameter portion axially inward of the larger diameter portion; and wherein the piston retainer is coupled to the piston at the reduced diameter portion.

Statement 6. The drill bit of statement 5, wherein the spring is disposed about the reduced diameter portion of the piston and in axial engagement with the larger diameter portion Statement 7. The drill bit of statement 5 or 6, further comprising: a recess defined in the exposed end of the piston to receive the wear element; and the wear element and recess having complementary stepped or conical configurations.

Statement 8. The drill bit of any of statements 1-7, further comprising: a piston geometry including one or more of a ratio of a piston length to a piston outer diameter within a range of between 0.5:1 and 3:1, a ratio of a piston outer diameter to a wear element diameter within a range of between 1.01:1 to 1.5:1.00, and a ratio of the gauge diameter to a piston outer diameter within a range of between 4:1 and 16:1.

Statement 9. The drill bit of any of statements 1-8, wherein the neutral position of the wear element is radially inward of the gauge diameter by between 0.010" and 0.125" (0.25 to 3.2 mm).

Statement 10. The drill bit of any of statements 1-9, further comprising: a damper, the damper including a damping fluid disposed in the cavity and a seal between the piston and the cavity.

Statement 11. The drill bit of any of statement 1-10, wherein the damping fluid comprises a non-Newtonian damping fluid or a ferrofluid activated by an electromagnet.

Statement 12. The drill bit of any of statement 1-11, further comprising: a gauge pad on the bit body having first and second steps of different diameters, wherein the first reciprocating gauge assembly is disposed on the first step; and a second reciprocating gauge assembly on the second step of the gauge pad and including a second piston reciprocably disposed in a second cavity, a second wear element on an exposed end of the second piston, and a second spring biasing the second piston outwardly to a second neutral position of the second wear element with respect to the gauge diameter.

Statement 13. The drill bit of statement 11 or 12, wherein the neutral position of the second wear element is radially inward of the neutral position of the first wear element.

Statement 14. The drill bit of any of statements 1-13, further comprising: a replaceable sleeve, an unsealed bearing grease, a polytetrafluoroethylene coating, a ceramic coating, a carbide layer, or a nitride layer, between the piston and the cavity.

Statement 15. The drill bit of any of statements 1-14, wherein the wear element is rotatably secured to the bit body.

Statement 16. A drill bit design method, comprising: obtaining a well plan including a plurality of drilling parameters, the drilling parameters including a drill bit size and a rock compressive strength; determining an expected side load on a drill bit based on the well plan; obtaining a stroke length based on the well plan for a reciprocating gauge assembly comprising a cavity defined in the bit body, a piston reciprocably disposed in the cavity, a wear element on an exposed end of the piston, and a piston retainer for moveably retaining the piston in the cavity; selecting a spring rate to bias the piston outwardly to a neutral position of the wear element under gauge; and configuring a bit design including reciprocating gauge assembly incorporating the drill bit size, stroke length, and spring rate.

Statement 17. The drill bit design method of statement 16, further comprising: obtaining bending-on-bit data; and adjusting one or both of the spring rate and the stroke length based on the bending-on-bit data.

Statement 18. The drill bit design method of statement 17, further comprising: adjusting one or both of the spring rate and the stroke length to achieve a desired side cutting efficiency for the well plan.

Statement 19. A method of drilling a wellbore into a formation, comprising: rotating a drill bit about a rotational axis; engaging a plurality of cutters secured to the bit body to cut the formation while rotating the drill bit, including using a gauge cutter to cut a gauge diameter; generating a lateral force on a gauge section of the drill bit while drilling; and using an under gauge wear element to limit engagement of a gauge cutter with the formation; and dynamically adjusting the position of the wear element under gauge in response to the lateral force.

Statement 20. The method of statement 19, where dynamically adjusting the position of the wear element under gauge in response to the lateral force comprises: outwardly biasing a piston disposed in a cavity on the bit body with the wear element on an outwardly facing end of the piston; and moveably retaining the piston in the cavity with a fastener extending transversely through a retention hole on the piston and into the bit body, wherein the retention hole in the piston is wider than the fastener in an axial direction of the piston to allow reciprocation of the piston within the cavity.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drill bit, comprising:

a bit body defining a rotational axis;

a plurality of cutters secured to the bit body, including a gauge cutter disposed on a gauge section and defining a gauge diameter of the drill bit; and a reciprocating gauge assembly comprising a cavity defined in the bit body, a piston reciprocably disposed in the cavity, a wear element on an outwardly facing end of the piston, a piston retainer for moveably retaining the piston in the cavity comprising a retention hole defined transversely through the piston and a fastener extending through the retention hole and into the bit body to retain the piston within the cavity, wherein the retention hole in the piston is wider than the fastener in an axial direction of the piston to allow reciprocation of the piston within the cavity; and a spring biasing the piston outwardly to a neutral position of the wear element under gauge.

2. The drill bit of claim 1, further comprising:

a receiving hole extending from an exterior of the bit body to the retention hole in the piston for receiving the fastener through the receiving hole into the retention hole; and wherein the retention hole is angled between 1 to 50 degrees with respect to an outer face of the piston.

3. The drill bit of claim 2, further comprising a threaded connection between the fastener and the receiving hole on the bit body.

4. The drill bit of claim 1, wherein the piston comprises a dual-diameter outer profile including a larger diameter portion that extends to the outwardly-facing end of the piston and a reduced diameter portion axially inward of the larger diameter portion; and wherein the piston retainer is coupled to the piston at the reduced diameter portion.

5. The drill bit of claim 4, wherein the spring is disposed about the reduced diameter portion of the piston and in axial engagement with the larger diameter portion.

6. The drill bit of claim 4, further comprising:

a recess defined in the exposed end of the piston to receive the wear element; and the wear element and recess having complementary stepped or conical configurations.

7. The drill bit of claim 1, further comprising:

a piston geometry including one or more of a ratio of a piston length to a piston outer diameter within a range of between 0.5:1 and 3:1, a ratio of a piston outer diameter to a wear element diameter within a range of between 1.01:1 to 1.5:1.00, and a ratio of the gauge diameter to a piston outer diameter within a range of between 4:1 and 16:1.

8. The drill bit of claim 1, wherein the neutral position of the wear element is radially inward of the gauge diameter by between 0.010" and 0.125" (0.25 to 3.2 mm).

9. The drill bit of claim 1, further comprising:

a damper, the damper including a damping fluid disposed in the cavity and a seal between the piston and the cavity.

10. The drill bit of claim 9, wherein the damping fluid comprises a non-Newtonian damping fluid or a ferrofluid activated by an electromagnet.

11. The drill bit of claim 1, further comprising:

a replaceable sleeve, an unsealed bearing grease, a polytetrafluoroethylene coating, a ceramic coating, a carbide layer, or a nitride layer, between the piston and the cavity.

12. The drill bit of claim 1, wherein the wear element is rotatably secured to the bit body.

13. A drill bit comprising:

a bit body defining a rotational axis;

a plurality of cutters secured to the bit body, including a gauge cutter disposed on a gauge section and defining a gauge diameter of the drill bit;

a first reciprocating gauge assembly comprising a cavity defined in the bit body, a piston reciprocably disposed in the cavity, a wear element on an outwardly facing end of the piston, a piston retainer for moveably retaining the piston in the cavity, and a spring biasing the piston outwardly to a neutral position of the wear element under gauge;

a gauge pad on the bit body having first and second steps of different diameters, wherein the reciprocating gauge assembly is disposed on the first step; and a second reciprocating gauge assembly on the second step of the gauge pad and including a second piston reciprocably disposed in a second cavity, a second wear element on an exposed end of the second piston, and a second spring biasing the second piston outwardly to a second neutral position of the second wear element with respect to the gauge diameter.

14. The drill bit of claim 13, wherein the neutral position of the second wear element is radially inward of the neutral position of the first wear element.

15. A method of drilling a wellbore into a formation, comprising:

rotating a drill bit about a rotational axis;

engaging a plurality of cutters secured to a bit body of the drill bit to cut the formation while rotating the drill bit, including using a gauge cutter to cut a gauge diameter;

generating a lateral force on a gauge section of the drill bit while drilling; and using an under gauge wear element to limit engagement of the gauge cutter with the formation; and dynamically adjusting the position of the wear element under gauge in response to the lateral force, including outwardly biasing a piston disposed in a cavity on the bit body with the wear element on an outwardly facing end of the piston and moveably retaining the piston in the cavity with a fastener extending transversely through a retention hole on the piston and into the bit body, wherein the retention hole in the piston is wider than the fastener in an axial direction of the piston to allow reciprocation of the piston within the cavity.

* * * * *